US007973743B2

(12) United States Patent
Shin et al.

(10) Patent No.: US 7,973,743 B2
(45) Date of Patent: Jul. 5, 2011

(54) DISPLAY PANEL, LIGHT EMITTING DISPLAY DEVICE USING THE SAME, AND DRIVING METHOD THEREOF

(75) Inventors: Dong-Yong Shin, Suwon-si (KR); Yojiro Matsueda, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 939 days.

(21) Appl. No.: 10/969,317

(22) Filed: Oct. 19, 2004

(65) Prior Publication Data

US 2005/0110721 A1 May 26, 2005

(30) Foreign Application Priority Data

Nov. 20, 2003 (KR) ..... 10-2003-0082681

(51) Int. Cl.
*G09G 3/30* (2006.01)

(52) U.S. Cl. ..... 345/76

(58) Field of Classification Search ..... None
See application file for complete search history.

(56) References Cited

U.S. PATENT DOCUMENTS

| | | | | |
|---|---|---|---|---|
| 6,798,145 | B2 * | 9/2004 | Ishizuka | 315/169.1 |
| 6,989,826 | B2 * | 1/2006 | Kasai | 345/204 |
| 2003/0030602 | A1 * | 2/2003 | Kasai | 345/76 |
| 2003/0062524 | A1 * | 4/2003 | Kimura | 257/72 |

FOREIGN PATENT DOCUMENTS

| | | | |
|---|---|---|---|
| CN | 14202212 | A | 3/2003 |
| CN | 1427385 | A | 7/2003 |
| EP | 1 450 343 | A1 | 8/2004 |
| JP | 2003-050564 | A | 2/2003 |
| JP | 2003-66905 | | 3/2003 |
| JP | 2003-76327 | | 3/2003 |
| JP | 2003-114645 | A | 4/2003 |
| JP | 2003-157049 | A | 5/2003 |
| KR | 2003-0013273 | | 2/2003 |
| WO | WO 03/091980 | A1 | 11/2003 |

OTHER PUBLICATIONS

Korean Patent Abstracts, Publication No. 1020030013273; Publication Date: Feb. 14, 2003; in the name of Kasai.

Patent Abstracts of Japan for Publication No. 2003-066905, dated Mar. 5, 2003 in the name of Katsumi Adachi, et al.

Patent Abstracts of Japan for Publication No. 2003-076327, dated Mar. 14, 2003 in the name of Koichi Iguchi.

Patent Abstracts of Japan for Publication No. 2003-114645, dated Apr. 18, 2003 in the name of Toshiyuki Kasai.

* cited by examiner

*Primary Examiner* — Sumati Lefkowitz
*Assistant Examiner* — Tammy Pham
(74) *Attorney, Agent, or Firm* — Christie, Parker & Hale, LLP

(57) ABSTRACT

A light emitting display device including data lines, signal lines, pixel circuits, a data driver, and a precharger. Each pixel circuit includes a first switch, a transistor, a capacitor, and a light emitting element. The precharger supplies a precharge current of X times a data current to a corresponding data line in response to a control signal. When the first switch transmits the data current provided from the corresponding data line in response to a first level scan signal while the corresponding data line is precharged, a voltage corresponding to the data current is charged in the capacitor. A current corresponding to the charged voltage is supplied to the light emitting element through the transistor in response to a second level scan signal, and the light emitting element emits light.

19 Claims, 8 Drawing Sheets

DISPLAY PANEL, LIGHT EMITTING DISPLAY DEVICE USING THE SAME, AND DRIVING METHOD THEREOF

CROSS REFERENCE TO RELATED APPLICATION

This application claims priority to and the benefit of Korea Patent Application No. 10-2003-0082681 filed on Nov. 20, 2003 in the Korean Intellectual Property Office, the entire content of which is incorporated herein by reference.

BACKGROUND OF THE INVENTION (a) Field of the Invention

The present invention relates to a display panel, a light emitting display device using the same, and a driving method thereof. More specifically, the present invention relates to an organic electro luminescent (EL) display panel, a light emitting display device using the same, and a driving method thereof.

(b) Description of the Related Art

In general, an organic EL display electrically excites a phosphorous organic compound to emit light, and it voltage- or current-drives N×M organic emitting cells to display images. The organic emitting cell includes an anode (e.g., indium tin oxide (ITO)), an organic thin film, and a cathode layer (metal). The organic thin film has a multi-layer structure including an emitting layer (EML), an electron transport layer (ETL), and a hole transport layer (HTL) for maintaining balance between electrons and holes and improving emitting efficiencies. Further, the organic emitting cell includes an electron injecting layer (EIL) and a hole injecting layer (HIL).

Methods for driving the organic emission cells are classified as a passive matrix method, and an active matrix method using thin film transistors (TFTs). In the passive matrix method, anodes and cathodes cross (i.e., cross over or intersect) with each other, and lines are selected to drive the organic emission cells. In the active matrix method, a TFT is coupled to each ITO pixel electrode, and drives the line according to a voltage maintained by a capacitance of a capacitor coupled to a gate of the TFT. The active matrix method is further categorized, depending on formats of signals applied to the capacitor for establishing the voltage, as a voltage programming method or a current programming method.

The pixel circuit of the conventional voltage programming method has difficulties in obtaining high gray scales because of the deviations of the threshold voltage $V_{TH}$ and the carrier mobility, the deviations being caused by non-uniformity of a manufacturing process. For example, in order to represent 8-bit (i.e., 256) gray scales in the case of driving TFTs with the voltage of 3V (volts), the voltage gradation applied to the gate of the thin film transistor is less than 12 mV(=3V/256). Therefore, if the deviation of the threshold voltage of the TFT caused by the non-uniformity of the manufacturing process is 100 mV, it is difficult to represent high gray scales.

The pixel circuit of the current programming method achieves substantially uniform display characteristics when the driving transistor in each pixel has non-uniform voltage-current characteristics, provided that a current source for supplying the current to the pixel circuit is substantially uniform throughout the whole panel.

However, the pixel circuit of the current programming method has a long data programming time because of a parasitic capacitance component of the data line. In detail, the time (i.e., the data programming time) for programming the data on the current pixel line is influenced by a voltage state of the data line according to the data of a previous pixel line; in particular, the data programming time is further lengthened when the data line is charged with a voltage which has a large difference with the target voltage (i.e., the voltage corresponding to the current data). This phenomenon increases as the gray level becomes lower (i.e., near black.). FIG. 1 is a graph showing variations of data programming times per gray in the conventional light emitting display device. The times t1 to t7 in FIG. 1 represent the data programming times, and the legend on the right of the graph indicate gray levels of the data programmed to the pixel circuit coupled to the previous pixel line.

For example, when the gray level of the data programmed to the pixel circuit coupled to the previous pixel line is "8" and the gray level of the data to be programmed to the pixel circuit coupled to the current pixel line is 8 (i.e., a point where a curve meets the horizontal axis), the time needed for data programming is almost "0" since there is no difference between the voltage state of the data line and the target voltage.

However, as the gray level of the data to be currently programmed becomes farther from the gray level of 8, the time needed for data programming is increased since the difference between the voltage state of the data line and the target voltage increases.

The time needed for data programming is inversely proportional to the magnitude of the data current for driving the data line, and hence, when the gray level is lowered, the data current for driving the data line is reduced, and the data programming time is steeply increased. That is, as can be seen in FIG. 1, as the gray level becomes lower (i.e., near the black level), the data voltage is changed to a large voltage range with a low current, and the data programming time is increased.

SUMMARY OF THE INVENTION

In an exemplary embodiment of the present invention, a data programming time is reduced in a light emitting display device based on a current driving method.

In another exemplary embodiment of the present invention, accurate data representation is provided in a light emitting device.

In one aspect of the present invention, a light emitting display device includes: a plurality of data lines, arranged in one direction, for transmitting data currents; a plurality of signal lines, crossing the data lines, for transmitting scan signals; and a plurality of pixel circuits coupled to the data lines and the signal lines. Each said pixel circuit is formed at an area located where a corresponding said data line and a corresponding said signal line cross over each other, and displays an image corresponding to a corresponding said data current, which is applied thereto. A data driver transmits the data currents to the data lines, and a precharger supplies precharge currents to the data lines in response to a control signal, which is applied thereto.

A magnitude of each said precharge current may be X times that of the corresponding said data current, where X is a real number greater than 1.

Each said pixel circuit may include a first switch for transmitting the corresponding said data current provided from the corresponding said data line in response to a corresponding said scan signal applied from the corresponding said signal line, a capacitor for charging a voltage corresponding to the corresponding said data current provided from the first switch, a light emitting element, and a first transistor for supplying a current corresponding to the voltage charged in the capacitor to the light emitting element.

The precharger may include a second switch for transmitting a corresponding said precharge current provided from the corresponding said data line in response to the control signal; and a second transistor for supplying a current corresponding to the corresponding said precharge current to the corresponding said data line.

A ratio of (a channel width)/(a channel length) of the second transistor may be X times a ratio of (a channel width)/(a channel length) of the first transistor.

The corresponding said precharge current provided from the corresponding said data line may flow through the second transistor in response to the control signal during a first period. The voltage corresponding to the corresponding said data current provided from the corresponding said data line may be charged in the capacitor in response to a first level scan signal of the corresponding said scan signal during a second period. The light emitting element may emit light according to the current corresponding to the voltage charged in the capacitor in response to a second level scan signal of the corresponding said scan signal during a third period.

A ratio of (a channel width)/(a channel length) of the second transistor may be X−1 times a ratio of (a channel width)/(a channel length) of the first transistor.

A current which is X−1 times the corresponding said data current in the corresponding said precharge current provided from the corresponding said data line may flow through the second transistor in response to the control signal, and a voltage which corresponds to the corresponding said data current provided from the corresponding said data line may be charged in the capacitor in response to a first level scan signal of the corresponding said scan signal during a first period. The voltage corresponding to the corresponding said data current provided from the corresponding said data line may be charged in the capacitor in response to the first level scan signal of the corresponding said scan signal during a second period, and the light emitting element may emit light according to the current corresponding to the voltage charged in the capacitor in response to a second level scan signal of the corresponding said scan signal during a third period.

The first switch may be operated in response to a first level scan signal of the corresponding said scan signal provided from the corresponding said signal line, and the light emitting display device may further include a third switch for supplying the current provided from the first transistor to the light emitting element in response to a second level scan signal of the corresponding said scan signal provided from the corresponding said signal line.

Each said pixel circuit may further include a fourth switch for charging the voltage corresponding to the corresponding said data current provided from the corresponding said data line in the capacitor in response to the first level scan signal of the corresponding said scan signal.

Each said pixel circuit may further include a third transistor for forming a path for transmitting the current provided from the corresponding said data line and supplied through the first switch, and a third switch for performing a switching operation between the third transistor and the capacitor in response to the corresponding said scan signal, wherein the first transistor and the third transistor form a current mirror.

A ratio of (a channel width)/(a channel length) of the second transistor may be X−1 times a ratio of (a channel width)/(a channel length) of the third transistor.

The precharger may be provided on an opposite side of the data driver with respect to the pixel circuits.

The signal lines may include select signal lines for transmitting first scan signals, and emit select signal lines for transmitting second scan signals. Each said pixel circuit may write as a voltage the corresponding said data current provided from the corresponding said data line in response to a corresponding said first scan signal, and may perform a display operation according to the written voltage in response to a corresponding said second scan signal.

In another aspect of the present invention, a display panel includes a plurality of data lines, arranged in one direction, for transmitting data currents, a plurality of signal lines, crossing the data lines, for transmitting scan signals, and a pixel circuit. The pixel circuit is formed at a pixel area located where one said data line and one said signal line cross over each other, and includes a first switch for transmitting one said data current provided from the one said data line in response to one said scan signal applied from the one said signal line. The pixel circuit also includes a capacitor for charging a voltage corresponding to the one said data current provided from the first switch, a light emitting element, and a first transistor for supplying a current corresponding to the voltage charged in the capacitor to the light emitting element. The precharge current which is X times the one said data current is supplied to the one said data line before the one said data current is supplied to the one said data line.

The current which is X−1 times the one said data current in the precharge current supplied through the one said data line may be bypassed when supplying the precharge current, the first switch is turned on in response to the one said scan signal, and the voltage which corresponds to the one said data current is precharged in the capacitor.

A precharger for supplying a precharge current which is X times the one said data current to the one said data line is formed on the display panel.

In still another aspect of the present invention, a method for driving a light emitting display device including a pixel circuit formed at a pixel area located where a data line and a signal line cross over each other, is provided. The pixel circuit includes a capacitor, a transistor for supplying a current corresponding to a voltage charged in the capacitor, and a light emitting element. The method includes: (a) supplying a precharge current which is X times the data current to the data line to precharge the data line; (b) charging a voltage which corresponds to the data current transmitted from the data line in the capacitor in response to a first level scan signal provided from the signal line; and (c) allowing the light emitting element to emit light in response to a current which corresponds to the voltage charged in the capacitor in response to a second level scan signal provided from the signal line.

The step (a) may include: supplying the precharge current which is X times the data current, where X is a real number greater than 1; bypassing the current which is X−1 times the data current in the precharge current; and charging the voltage which corresponds to the data current in response to the first level scan signal transmitted from the signal line.

A time for performing the precharge of the data line is greater than 1/X times a horizontal period of the light emitting display device.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive.

To clarify the present invention, one or more parts which are not described in the specification have been omitted from the drawings. Coupling a first element to a second element refers to both the cases of: 1) directly coupling the first element to the second element; and 2) coupling the first element to the second element with a third element provided therebetween.

A light emitting display device, a corresponding pixel circuit, and a driving method thereof according to exemplary embodiments of the present invention will be described in detail with reference to the drawings. The light emitting display device to be subsequently described includes an organic EL display device.

Figure 1:
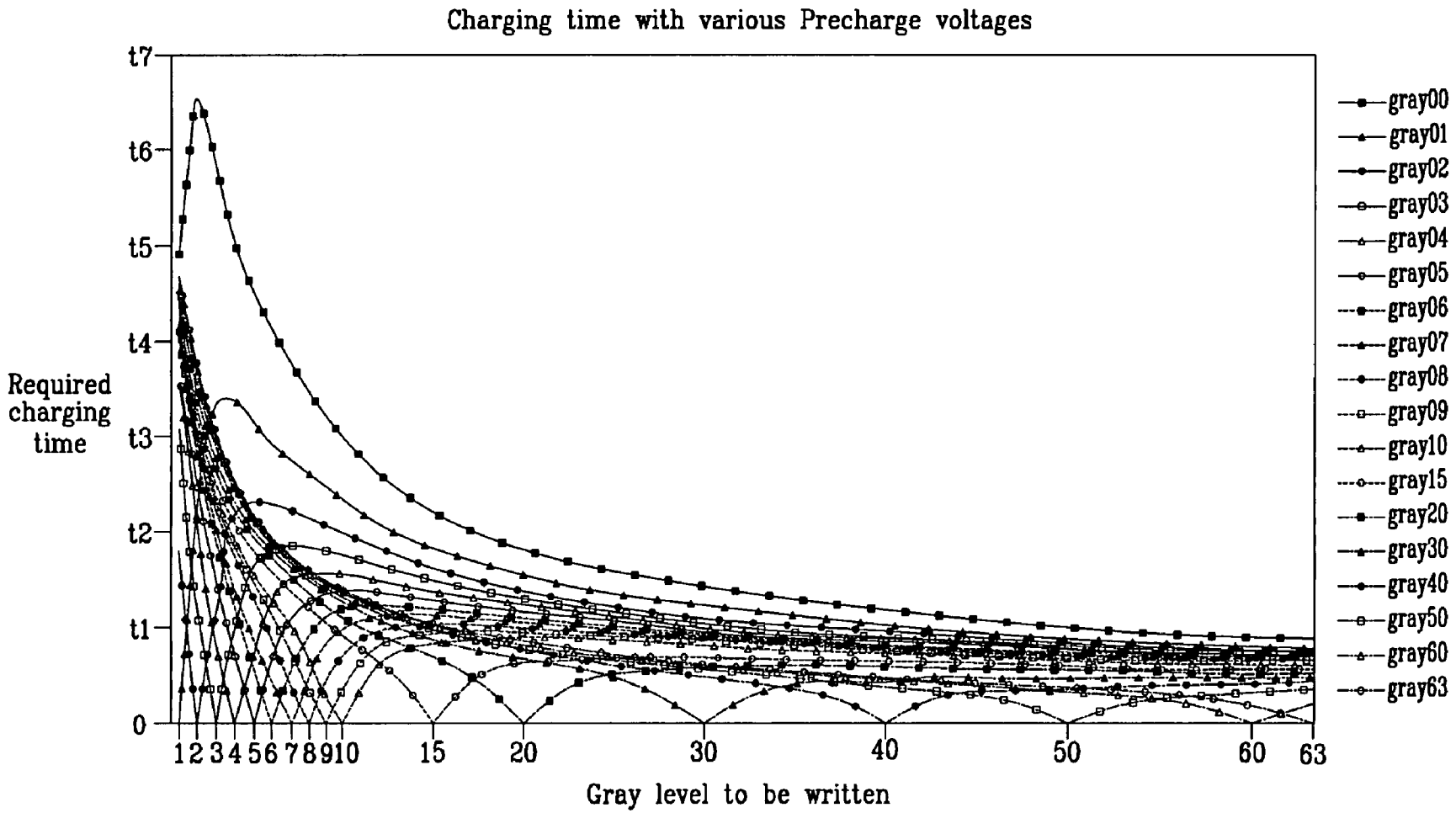
FIG. 1 is a graph for representing variations of data programming times per gray level in a conventional display device.
Figure 2:
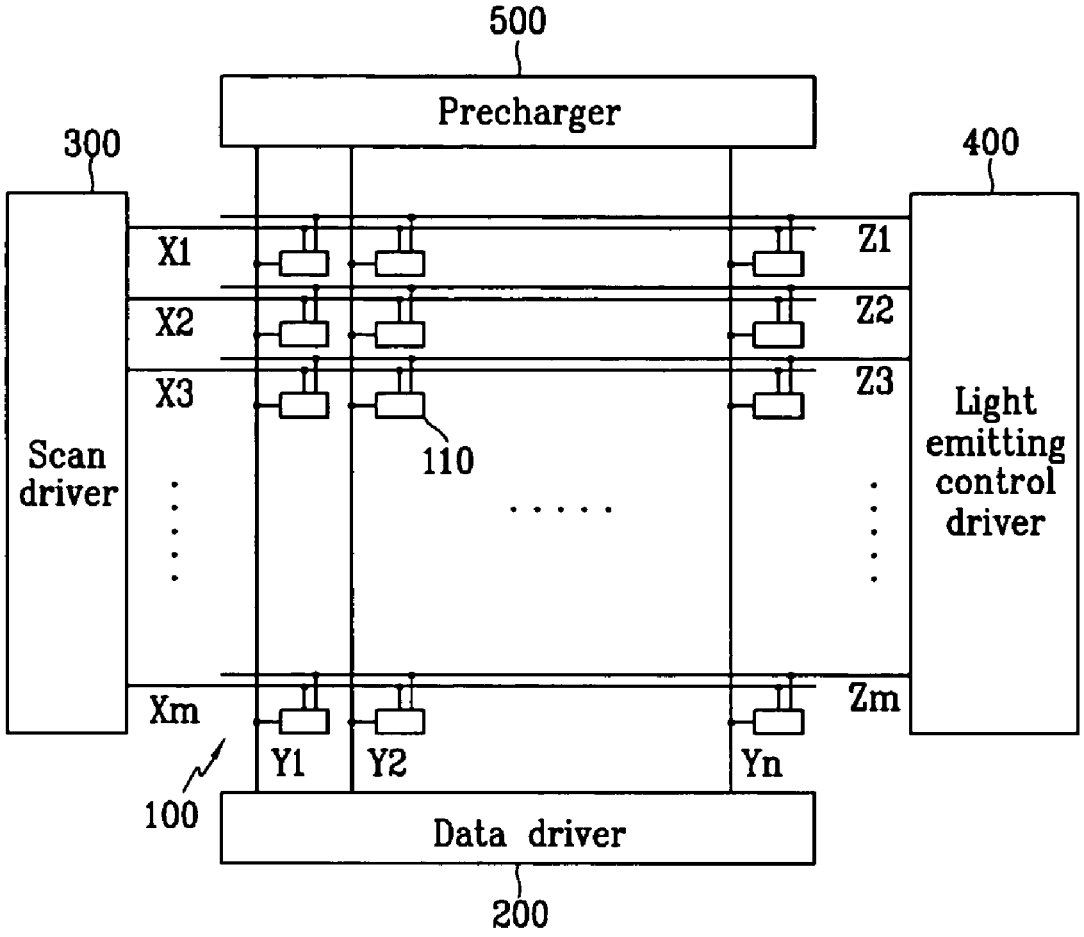
FIG. 2 shows a brief plane view of a light emitting display device according to an exemplary embodiment of the present invention.

FIG. 2 shows a brief plane view of a light emitting display device according to an exemplary embodiment of the present invention.

As shown in FIG. 2, the light emitting display device includes an organic EL display panel (referred to as a display panel hereinafter) 100, a data driver 200, a scan driver 300, a light emitting control driver 400, and a precharger 500.

The display panel 100 includes a plurality of data lines $Y_1$ to $Y_n$ arranged in the column direction, and a plurality of signal lines $X_1$ to $X_m$ and $Z_1$ to $Z_m$ arranged in the row direction. The pixel circuits 110 are arranged in rows and columns in a matrix form. The signal lines include a plurality of select signal lines $X_1$ to $X_m$ for transmitting first scan signals, and a plurality of emit signal lines $Z_1$ to $Z_m$ for transmitting second scan signals for controlling emit periods of the organic EL elements. In addition, the signal lines may also include a signal line for transmitting control signals for performing a precharge. The pixel circuits 110 are formed at pixel areas located at intersections between data lines $Y_1$ to $Y_n$ and the select and emit signal lines $X_1$ to $X_m$ and $Z_1$ to $Z_m$. The term "intersection" as used herein refers to an area at or proximate to the point where the two or more lines cross over one another. For example, the lines may be substantially perpendicular to each other.

The data driver 200 applies data currents $I_{DATA}$ to the data lines $Y_1$ to $Y_n$. The data driver 200 generates the data currents $I_{DATA}$ and added currents $(X-1)I_{DATA}$ for generating precharge currents. In particular, the data driver 200 generates the added current and the data current in a precharge operation of the pixel to be subsequently described so that a precharge current $XI_{DATA}$ may flow to the data line according to an operation by the precharger 500, and the data driver 200 generates the data current in a data programming operation. The data current and the added current can be generated by a current mirror circuit, and since the current generation process is known to a person skilled in the art, no corresponding description will be provided.

The scan driver 300 sequentially applies first scan signals for selecting pixel circuits to the select signal lines $X_1$ to $X_m$. The emit control driver 400 sequentially applies second scan signals for controlling light emission of the pixel circuits 110 to the emit signal lines $Z_1$ to $Z_m$.

The precharger 500 is driven by the applied control signals to transmit the precharge currents $XI_{DATA}$ to the data lines.

The scan driver 300, the light emitting control driver 400, the data driver 200 and/or the precharge driver 500, may be coupled to the display panel 100, they may be installed as a chip in a tape carrier package (TCP) attached and coupled to the display panel 100, or they may be installed as a chip on an flexible printed circuit (FPC) or a film attached and coupled to the display panel 100, which is referred to as a chip on flexible board, chip on film (COF) method. In addition, the scan driver 300, the light emitting control driver 400, the data driver 200 and/or the precharge driver 500 may be directly installed on a glass substrate of the display panel, which is referred to as a chip on glass COG) method, and may also be substituted with a driving circuit on the same layer as that of signal lines, data lines, and TFTs.

Figure 3:
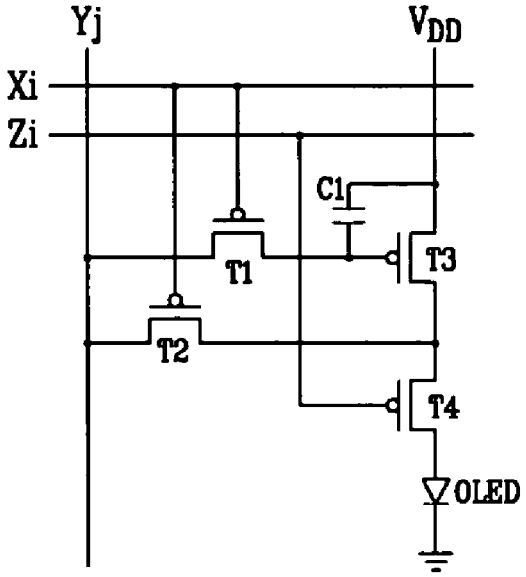
FIG. 3 shows a brief circuit diagram of a pixel circuit of a light emitting display device according to an exemplary embodiment of the present invention.
Figure 4:
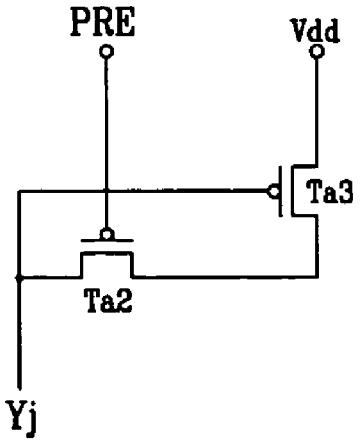
FIG. 4 shows a circuit diagram of a precharger according to an exemplary embodiment of the present invention.

Referring to FIGS. 3 and 4, the pixel circuit 110 and the precharger 500 according to the exemplary embodiment of the present invention will be described.

FIG. 3 shows a circuit diagram of the pixel circuit according to the exemplary embodiment of the present invention. For ease of description, FIG. 3 illustrates the pixel circuit coupled to the $j^{th}$ data line $Y_j$ and the $i^{th}$ signal lines $X_i$ and $Z_i$.

As shown, the pixel circuit 110 includes an organic EL element OLED, transistors T1, T2, T3 and T4, and a capacitor C1. The transistors T1 to T4 include PMOS transistors. It is desirable for the transistors to be TFTs which each have a gate electrode, a drain electrode, and a source electrode formed on the glass substrate of the display panel 100 as a control electrode and two main electrodes.

In detail, the three terminals of the transistor T1 are respectively coupled to the select signal line $X_i$, the data line $Y_j$, and the capacitor C1, and the transistor T1 transmits the data current $I_{DATA}$ provided by the data line $Y_j$ to a gate of the transistor T3 in response to the first scan signal provided by the select signal line $X_i$. In this instance, the data current is transmitted to the gate of the transistor T3 until the current which corresponds to the data current $I_{DATA}$ flows to a drain of the transistor T3. The capacitor C1 is coupled between the gate and a source of the transistor T3, and is charged with a voltage which corresponds to the data current $I_{DATA}$ provided by the data line $Y_j$. The current given in Equation 1 flows to the transistor T3 according to the voltage charged in the capacitor C1.

$$I_{OLED} = \frac{\beta}{2}(V_{GS} - V_{TH})^2 = I_{DATA} \quad \text{Equation 1}$$

where $V_{GS}$ is a voltage between the gate and the source of the transistor T3, $V_{TH}$ is a threshold voltage at the transistor T3, and β is a constant.

The transistor T4 is coupled between the transistor T3 and the organic EL element OLED, and electrically couples the transistor T3 to the organic EL element OLED in response to the low-level second scan signal provided by the emit signal line $Z_i$. The organic EL element OLED is coupled between the transistor T4 and a ground voltage, and emits light corresponding to the current supplied through the transistor T4. The transistor T2 transmits the data current $I_{DATA}$ applied on the data line $Y_j$, in response to the low-level first scan signal provided by the select signal line $X_i$, to the drain of the transistor T3.

FIG. 4 shows an equivalent circuit diagram of the precharger according to the exemplary embodiment of the present invention. While only the precharger associated with the data line $Y_j$ is illustrated in FIG. 4, it should be noted that the precharge 500 includes a plurality of the precharger circuits, one of which is represented in FIG. 4, for driving all of the data lines Y1 to Yn.

As shown, the precharger 500 includes transistors Ta3 and Ta2 which include PMOS transistors. In particular, the transistor Ta3 has X times the ratio of (a channel width: Width)/(a channel length: Length) of the transistor T3 for configuring the pixel circuit 110. Alternatively, the transistor Ta3 may have (X−1) times the ratio of the Width/Length of the transistor T3. As can be seen in FIGS. 3 and 4, the transistors Ta3 and T3 have the same polarities. That is, when the transistor T3 is a PMOS transistor, the transistor Ta3 is a PMOS transistor. In addition, it is desirable for the voltage of Vdd applied to the sources of the transistors Ta3 and T3 to be the same. The X is a real number greater than 1, and for ease of description, (the channel width: Width)/(the channel length: Length) will be simplified as "W/L."

In detail, a source and a drain of the transistor Ta2 are respectively coupled to the data line $Y_j$ and the transistor Ta3, and the transistor Ta2 transmits the precharge current $XI_{DATA}$ or $(X-1)I_{DATA}$ provided by the data line $Y_j$ to the drain of the transistor Ta3 in response to the control signal PRE applied to the gate of the transistor Ta2.

Figure 5A:
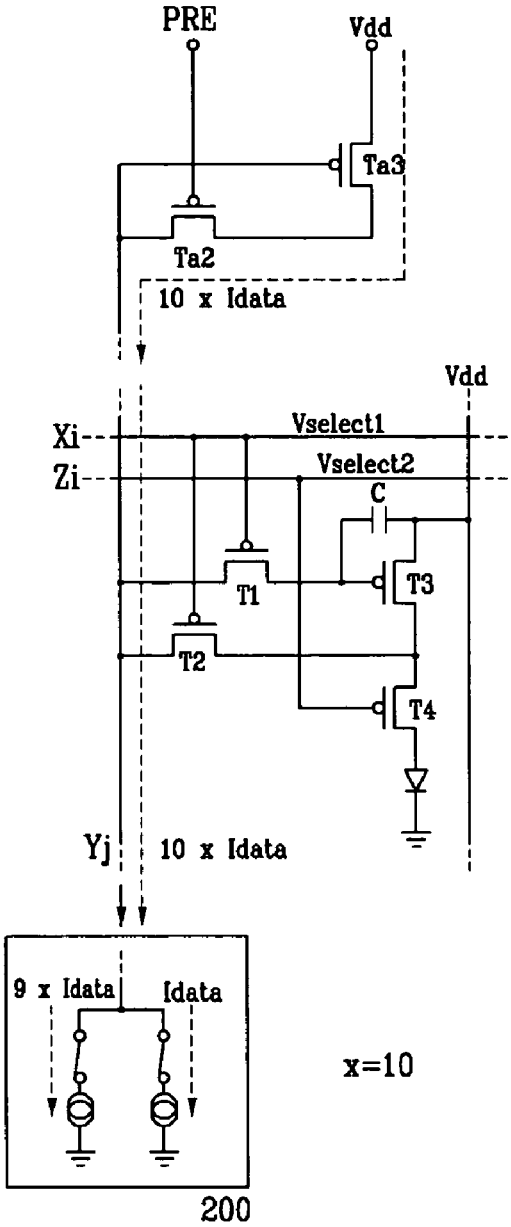
FIGS. 5A and 5B show current supply states according to an operation state of the light emitting display device according to a first exemplary embodiment of the present invention.
Figure 5B:
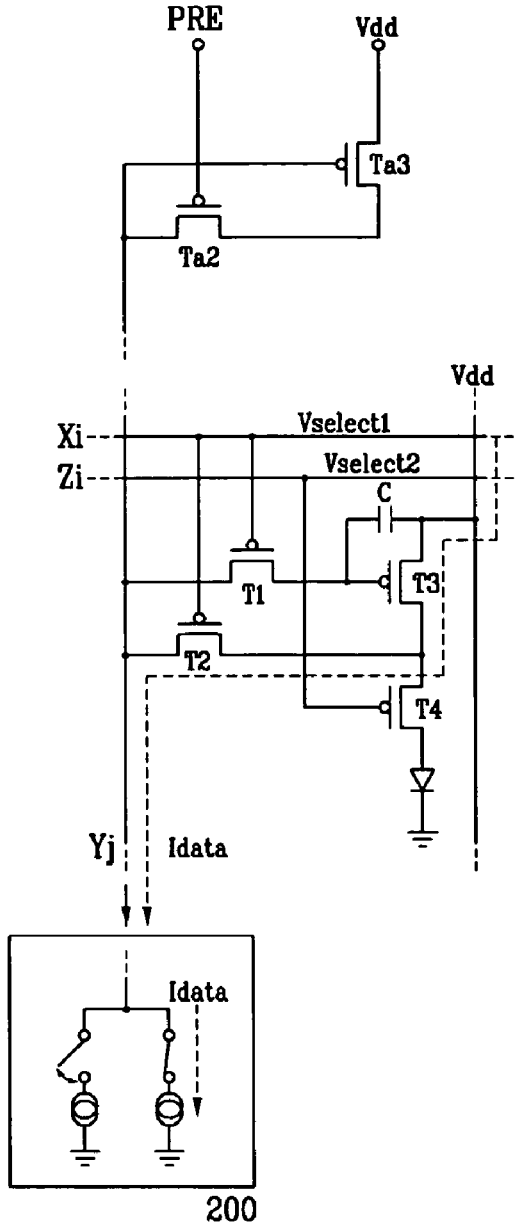
Figure 6:
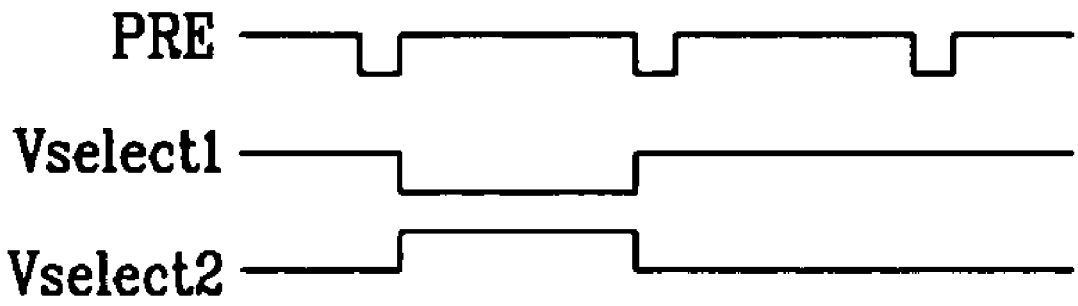
FIG. 6 shows a timing diagram of respective signals according to the first exemplary embodiment of the present invention.

Referring to FIGS. 5A, 5B, and 6, an operation of the light emitting display device according to a first exemplary embodiment of the present invention will be described in detail.

FIGS. 5A and 5B show a current supply state of the light emitting display device according to the first exemplary embodiment of the present invention. FIG. 5A shows a state in which the current is supplied in the precharge stage, and FIG. 5B shows a state in which the current is supplied in the data programming stage. While FIGS. 5A and 5B illustrate a specific case where X=10, X may be any suitable real number greater than 1. FIG. 6 shows a timing diagram of respective signals according to the first exemplary embodiment of the present invention.

A precharge operation is executed in order to reduce the data programming time before the data programming operation for supplying the data current to the data line is executed.

As shown in FIGS. 5A and 6, a control signal PRE for precharging is applied to the transistor Ta2 of the precharger 500, and an added current $(X-1)I_{DATA}$(i.e., $9\times I_{DATA}$) for generating a precharge current is concurrently generated together with the data current $I_{DATA}$ provided by the data driver 200, before a first scan signal is applied to the select signal line $X_i$.

Accordingly, the transistor Ta2 of the precharger 500 is turned on, the transistor Ta3 is diode-connected, and the precharge current ($I_{DATA}+(X-1)I_{DATA}=XI_{DATA}$) flows following the data line $Y_j$. For the case where X=10, the precharge current is $10\times I_{DATA}$ as shown in FIG. 5A.

In this instance, the current $XI_{DATA}$ flowing to the transistor Ta3 is expressed in Equation 2 since the transistor Ta3 has X times the ratio of W/L of the transistor T3 of the pixel circuit 110 in this case.

$$XI_{DATA} = \frac{X\beta}{2}(V_{GS} - V_{TH})^2 \quad \text{Equation 2}$$

where β has a characteristic of $[\mu C_{ox}(W/L)]$.

Therefore, the voltage which substantially corresponds to the current of $I_{DATA}$ is applied at the data line $Y_j$.

When a first scan signal Vselect1 is applied to the select signal line and the data current $I_{DATA}$ is generated from the data driver 200 after the precharge operation, the transistor T1 is turned on by the first scan signal Vselect1, and the voltage corresponding to the data current $I_{DATA}$ provided by the data lines $Y_1$ to $Y_n$ is charged in the capacitors C1 of the respective pixel circuits coupled to the select signal line $X_i$. The transistor T2 is turned on by the first scan signal Vselect1, and the transistor T3 is diode-connected. Hence, the capacitor C1 is charged with the voltage corresponding to the data current $I_{DATA}$ flowing through the transistor T3, and the corresponding voltage is charged in the capacitor C1 until no current flows to the transistor T1. In particular, since the precharge voltage (the voltage near a voltage which corresponds to the current of $I_{DATA}$) has been applied to the data line $Y_j$ according to the previous precharge operation, the capacitor C1 is quickly charged with the voltage corresponding to the data current of $I_{DATA}$.

When the charging process is finished, the transistors T1 and T2 are turned off, and the transistor T4 is turned on according to a second scan signal Vselect2 applied from the emit signal line $Z_i$ so that the data current $I_{DATA}$ is supplied to the organic EL element OLED through the transistor T4 and the organic EL element OLED emits light corresponding to the current.

Since the data programming operation is performed after the current precharge operation, the voltage charging process according to the data current is quickly executed and the gray scales are represented more accurately.

The current precharge operation can be performed in a manner different from the above-described first exemplary embodiment.

Figure 7A:
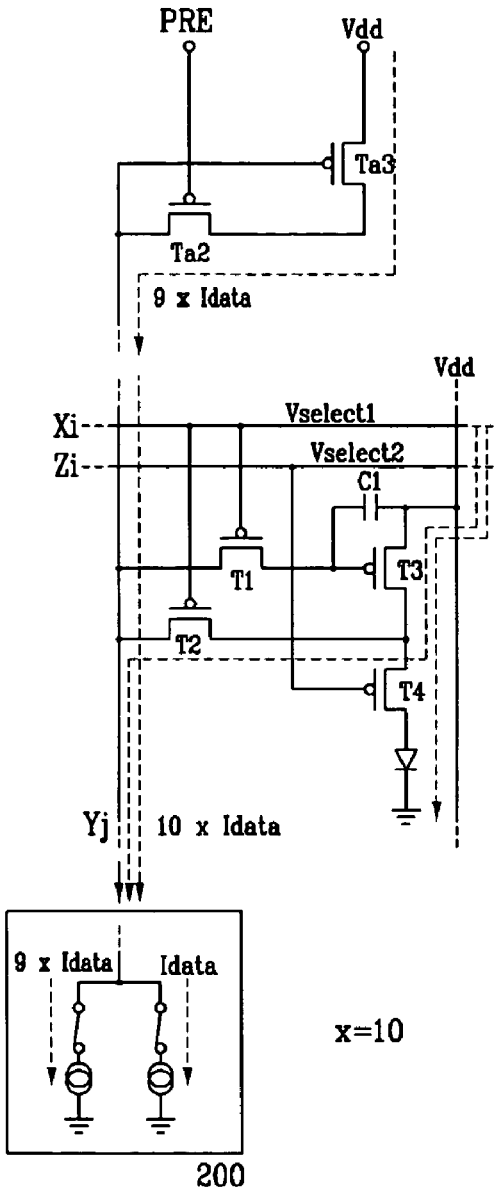
FIGS. 7A and 7B show current supply states according to an operation state of the light emitting display device according to a second exemplary embodiment of the present invention.
Figure 7B:
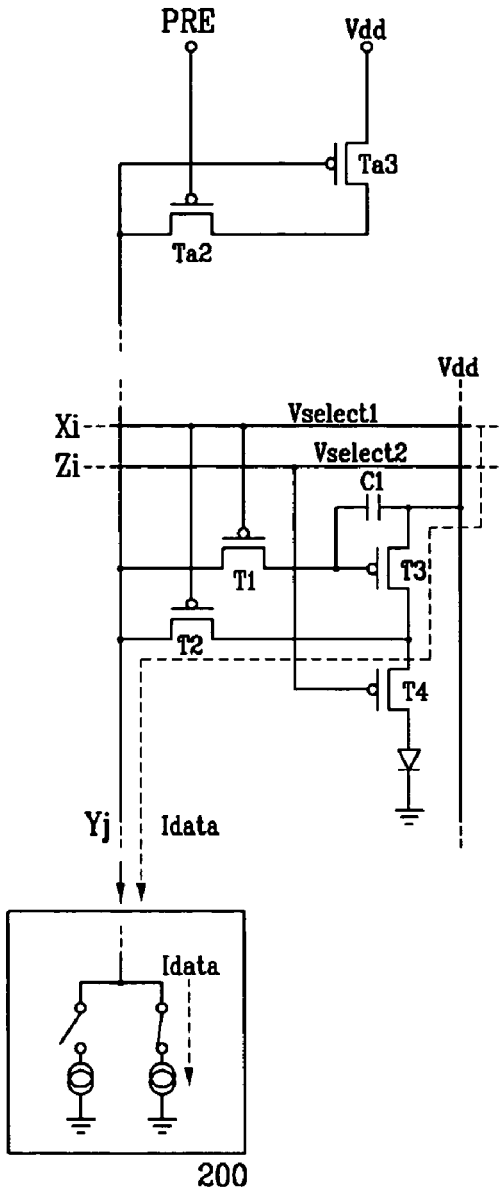
Figure 8:
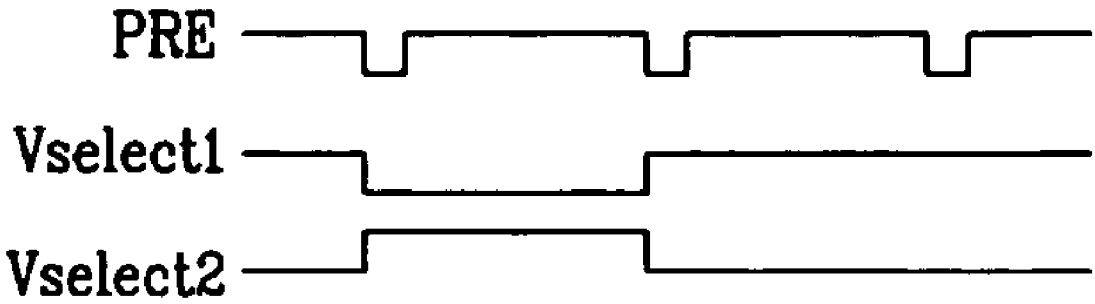
FIG. 8 shows a timing diagram of respective signals according to the second exemplary embodiment of the present invention.

FIGS. 7A and 7B show a current supply state of the light emitting display device according to a second exemplary embodiment of the present invention. FIG. 7A shows a state in which the current is supplied in the precharge stage, and FIG. 7B shows a state in which the current is supplied in the data programming stage. While FIGS. 7A and 7B illustrate a specific case where X=10, X may be any suitable real number greater than 1. FIG. 8 shows a timing diagram of respective signals according to the second exemplary embodiment of the present invention.

Differing from the first exemplary embodiment, the control signal and the first scan signal are concurrently output at the precharge operation, and the ratio of W/L of the transistor Ta3 of the precharger 500 is X−1 times the ratio of W/L of the transistor Ta3 in the second exemplary embodiment.

As shown in FIGS. 7A and 8, when a control signal PRE for precharging and a first scan signal Vselect1 are applied, and the data current $I_{DATA}$ provided by the data driver 200 and an added current $(X-1)I_{DATA}$ for generating a precharge current are generated, the precharge current $XI_{DATA}$ flows through the data line $Y_j$.

That is, the transistor Ta2 of the precharger 500 is turned on to diode-connect the transistor Ta3, and the transistor T2 of the pixel circuit 110 is turned on to diode-connect the transistor T3. In this instance, since the ratio of W/L of the transistor Ta3 is X−1 times the ratio of W/L of the transistor T3, the current of $(X-1)I_{DATA}$ flows through the transistor Ta3, and the current of $I_{DATA}$ flows through the transistor T3. As a result, the capacitor C1 is charged with the voltage which corresponds to the current of $I_{DATA}$ through the transistor T3.

When the output process of the control signal PRE is stopped according to the termination of the precharge process (i.e., switched to a high level from a low level) and the data current $I_{DATA}$ is generated from the data driver 200, the voltage which corresponds to the data current $I_{DATA}$ provided by the data line $Y_j$ is charged in the capacitor C1 in the same manner as that of the first exemplary embodiment. In this instance, since the precharge voltage (i.e., the voltage near a voltage which corresponds to the current of $I_{DATA}$) has been applied to the capacitor C1 according to the previous precharge operation, the capacitor C1 is quickly charged with the voltage corresponding to the data current of $I_{DATA}$.

When the charging process is finished, the transistor T4 is turned on according to a second scan signal Vselect2 applied from the emit signal line $Z_i$ so that the data current $I_{DATA}$ is supplied to the organic EL element OLED, and the organic EL element OLED emits light corresponding to the current in the same manner as that of the first exemplary embodiment.

In the first and second exemplary embodiments, the transistors T1 to T4 of the respective pixel circuit are realized with the same type transistors (e.g., PMOS transistors), and the signal lines are divided into select signal lines for selecting the pixel circuits and the emit signal lines for controlling light emission of the pixel circuits so that the operation for programming the data and emitting light of the pixel circuits may be executed. In other embodiments, the operation for programming the data and emitting light of the pixel circuits may be performed using a single signal line. In this case, the transistor (i.e., the transistor that replaces the transistor T4) for supplying the current for light emission to the organic EL element from the pixel circuit 110 is of a type different from the type of the transistors T1 and T2. For example, when the transistors T1 and T2 are realized with the PMOS transistors as described above, the transistor replacing the transistor T4 is realized with an NMOS transistor. Therefore, the transistors T1 and T2 are operated according to the first level scan signal (e.g., a low level signal) applied through a single signal line to thereby perform a data writing operation, and the transistor replacing the transistor T4 is operated according to the second level scan signal (e.g., a high level signal) applied through the signal line to thereby perform a light emission operation depending on the written data.

The precharge method can also be applied to a case in which the light emitting display device has a pixel circuit with a configuration different from that of the pixel circuits described above in reference to the first and second exemplary embodiments.

Figure 9:
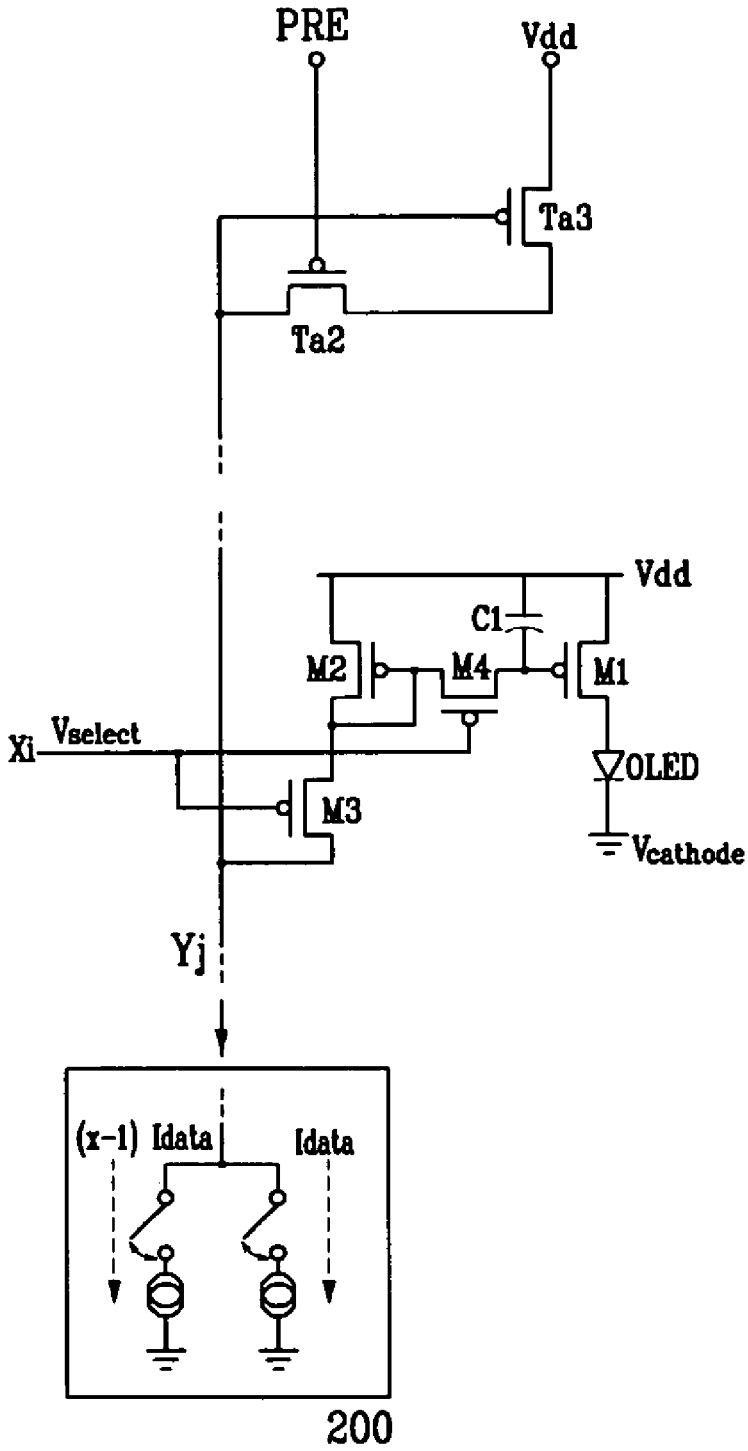
FIG. 9 shows a configuration diagram of a pixel circuit and a precharger according to a third exemplary embodiment of the present invention.

FIG. 9 shows a configuration diagram of a pixel circuit and a precharger according to a third exemplary embodiment of the present invention. The pixel circuit of FIG. 9 may be applied to a light emitting display device similar to the light emitting display device of FIG. 2, except that the light emitting control driver 400 and the emit signal lines $Z_1$ to $Z_m$ would not be needed for the light emitting display device having pixel circuits shown in FIG. 9.

The pixel circuit includes an organic EL element OLED, transistors M1, M2, M3 and M4, and a capacitor C1. The transistors M1 to M4 include PMOS transistors. In detail, a cathode voltage of Vcathode (or a ground voltage) is applied to a cathode electrode of the organic EL element OLED, and a drain electrode of the transistor M1 is coupled to an anode electrode of the organic EL element OLED. A power supply voltage Vdd is applied to a source electrode of the transistor M1, and a capacitor C1 is coupled between a gate electrode and the source electrode thereof. A gate electrode and a drain electrode of the transistor M2 are coupled with each other, thereby diode-connecting the transistor M2, and the power supply voltage Vdd is applied to a source electrode of the transistor M2. The two transistors M1 and M2 form a current mirror. The gate electrodes of the two transistors M1 and M2 are coupled to a source electrode and a drain electrode of the transistor M4, and a gate electrode of the transistor M4 is coupled to the signal line $X_i$. The drain electrode of the transistor M2 is coupled to a source electrode of the transistor M3. A gate electrode of the transistor M3 is coupled to the signal line $X_i$, and a drain electrode thereof is coupled to the data line $Y_j$.

The configuration of the precharger 500 corresponds to those of the first and second exemplary embodiments, and the ratio of W/L of the transistor Ta3 is X times or X−1 times the ratio of W/L of the transistor M2.

In a like manner as the first exemplary embodiment, when the ratio of W/L of the transistor Ta3 is X times the ratio of W/L of the transistor M2 in the light emitting display device having the above pixel circuit, a precharge operation is executed before a data programming operation is performed, in order to reduce a data programming time.

That is, the precharge current of $I_{DATA}+(X-1)I_{DATA}=XI_{DATA}$ flows following the data line $Y_j$ from the data driver 200 according to a control signal PRE for precharging. Since the transistor Ta3 has the ratio of W/L of X times that of the transistor M2 of the pixel circuit in FIG. 9, the voltage which substantially corresponds to the current of $I_{DATA}$ is applied to the data line $Y_j$.

When the scan signal Vselect is applied to the signal line $X_i$ and the data current $I_{DATA}$ is generated from the data driver 200 after the precharge operation, the two transistors M3 and M4 are turned on by the scan signal Vselect, the current flows to a path through the transistors M2 and M3, and a voltage is generated between the gate electrode and the source electrode of the transistor M2. The gate-source voltage at the transistor M2 is determined by the magnitude of the drain current of the transistor M2. In this instance, since the precharge voltage (i.e., the voltage near a voltage which corresponds to the current of $I_{DATA}$) has been applied to the data line $Y_j$ according to the previous precharge operation, the capacitor C1 is quickly charged with the corresponding voltage. After this, the capacitor C1 applies the charged voltage to the gate electrode of the transistor M1. The transistor M1 generates a drain current corresponding to the gate voltage, and the organic EL element OLED is driven by the drain current of the transistor M1 to perform a display operation with desired brightness.

Also, when the ratio of W/L of the transistor Ta3 of the precharger 500 is X−1 times the ratio of W/L of the transistor M2 as described in the second exemplary embodiment, the transistor Ta2 of the precharger 500 is turned on according to the control signal PRE applied in the precharge operation, the transistor Ta3 is diode-connected, and the transistor M3 of the pixel circuit is turned on to form a current flow path with the transistor M2. In this instance, since the ratio of W/L of the transistor Ta3 is X−1 times the ratio of W/L of the transistor M2, the current of $(X-1)I_{DATA}$ flows through the transistor Ta3, and the current of $I_{DATA}$ flows through the transistor M2. As a result, the gate-source voltage of the transistor M2 generated according to the current of $I_{DATA}$ is charged in the capacitor C1.

When the output process of the control signal PRE is stopped according to the termination of the precharge process and the data current $I_{DATA}$ is generated from the data driver 200, the transistors M3 and M4 are turned on according to the scan signal Vselect, the data current $I_{DATA}$provided from the data line $Y_j$ flows, and the gate-source voltage at the transistor M2 is charged in the capacitor Cst through the transistor M4. In this instance, since the precharge voltage (i.e., the voltage near the gate-source voltage at the transistor M2 generated according to the current of $I_{DATA}$) has been applied to the capacitor C1 according to the previous precharge operation, the capacitor C1 is quickly charged with the voltage, and a display operation is performed.

As described above, the third exemplary embodiment is a case of using a single signal line. Alternatively, it is possible to divide the signal line into two signal lines (e.g., a select signal line and an emit signal line) in the pixel circuit of FIG. 9. By way of example, a first scan signal may be supplied to the transistor M3 through the corresponding signal line, and the second scan signal may be supplied to the transistor M4 so as to perform the above-described precharge operation, and data writing and displaying operation.

As described, a precharge operation is executed with the current which is X times the data current to precharge the data line before the data current is supplied to the pixels in the exemplary embodiments of the present invention. Accordingly, the voltage charging process during the data programming operation after the precharge process is quickly performed.

The time for performing the precharge operation according to the above-described embodiments can be established to be greater than 1/X of the horizontal period. That is, since the speed of charging and discharging the parasitic capacitance of the data line is proportional to the current, the usage of X times the current reduces the charging time to 1/X. Therefore, it may be efficient to establish the precharge time to be greater than 1/X of the horizontal period.

While this invention has been described in connection with certain exemplary embodiments, it is to be understood that the present invention is not limited to the disclosed embodiments, but, on the contrary, is intended to cover various modifications and equivalent arrangements included within the spirit and scope of the appended claims, and equivalents thereof.

According to exemplary embodiments of the present invention, the time for charging the data lines is effectively reduced.

In particular, the data programming is more quickly performed by precharging the data line with a large voltage difference between the voltage (i.e., the target voltage) corresponding to the current data and the voltage caused by the data applied to the previous pixel line or caused by a precharge operation, to a voltage which is near the target voltage, thereby allowing faster data programming. Hence, accurate gray representation is performed.

What is claimed is:

1. A light emitting display device comprising:

a plurality of data lines, extending in one direction, for transmitting data currents;

a plurality of signal lines, crossing the data lines, for transmitting scan signals;

a plurality of pixel circuits coupled to the data lines and the signal lines, each said pixel circuit formed at an area where a corresponding said data line and a corresponding said signal line cross each other, the plurality of pixel circuits for displaying an image corresponding to the data currents, each pixel circuit comprising a first transistor for supplying a current to the light emitting element;

a data driver for transmitting the data currents to the data lines; and a precharger for supplying precharge currents to the data lines in response to a control signal, which is applied thereto, wherein the precharger is configured to supply each said precharge current having a magnitude that varies proportionally to a magnitude of a corresponding said data current, the precharger comprising a second transistor for supplying a current corresponding to the corresponding said precharge current to the corresponding said data line, wherein the first transistor and the second transistor are configured as a current mirror to supply the precharge current to the data lines prior to said current being supplied to the light emitting element, and wherein the second transistor is configured to supply a majority portion of the precharge current and the first transistor is configured to supply a remaining portion of the precharge current.

2. The light emitting display device of claim 1, wherein the magnitude of each said precharge current is X times that of the corresponding said data current, where X is a real number greater than 1.

3. The light emitting display device of claim 1, wherein each said pixel circuit comprises:

a first switch for transmitting the corresponding said data current provided from the corresponding said data line in response to a corresponding said scan signal applied from the corresponding said signal line;

a capacitor for charging a voltage corresponding to the corresponding said data current provided from the first switch; and a light emitting element, wherein the first transistor is adapted to supply the current corresponding to the voltage charged in the capacitor to the light emitting element.

4. The light emitting display device of claim 3, wherein the precharger further comprises a second switch for transmitting the corresponding said precharge current provided from the corresponding said data line in response to the control signal.

5. The light emitting display device of claim 4, wherein a ratio of (a channel width)/(a channel length) of the second transistor is X times a ratio of (a channel width)/(a channel length) of the first transistor, where X is a real number greater than 1.

6. The light emitting display device of claim 5, wherein the corresponding said precharge current provided from the corresponding said data line flows through the second transistor in response to the control signal during a first period, wherein the voltage corresponding to the corresponding said data current provided from the corresponding said data line is charged in the capacitor in response to a first level scan signal of the corresponding said scan signal during a second period, and wherein the light emitting element emits light according to the current corresponding to the voltage charged in the capacitor in response to a second level scan signal of the corresponding said scan signal during a third period.

7. The light emitting display device of claim 4, wherein a ratio of (a channel width)/(a channel length) of the second transistor is greater than a ratio of (a channel width)/(a channel length) of the first transistor.

8. The light emitting display device of claim 7, wherein a current which is greater than the corresponding said data current in the corresponding said precharge current provided from the corresponding said data line flows through the second transistor in response to the control signal, and a voltage which corresponds to the corresponding said data current is charged in the capacitor in response to a first level scan signal of the corresponding said scan signal during a first period, wherein the voltage corresponding to the corresponding said data current provided from the corresponding said data line is charged in the capacitor in response to the first level scan signal of the corresponding said scan signal during a second period, and wherein the light emitting element emits light according to the current corresponding to the voltage charged in the capacitor in response to a second level scan signal of the corresponding said scan signal during a third period.

9. The light emitting display device of claim 3, wherein the first switch is operated in response to a first level scan signal of the corresponding said scan signal provided from the corresponding said signal line, and wherein the light emitting display device further comprises a third switch for supplying the current provided from the first transistor to the light emitting element in response to a second level scan signal of the corresponding said scan signal provided from the corresponding said signal line.

10. The light emitting display device of claim 9, wherein each said pixel circuit further comprises a fourth switch for charging the voltage corresponding to the corresponding said data current provided from the corresponding said data line in the capacitor in response to the first level scan signal of the corresponding said scan signal.

11. The light emitting display device of claim 4, wherein the precharger is provided on an opposite side of the data driver with respect to the pixel circuits.

12. The light emitting display device of claim 1, wherein the signal lines comprise select signal lines for transmitting first scan signals, and emit select signal lines for transmitting second scan signals, and wherein each said pixel circuit writes as a voltage the corresponding said data current provided from the corresponding said data line in response to a corresponding said first scan signal, and performs a display operation according to the written voltage in response to a corresponding said second scan signal.

13. A display panel comprising:

a plurality of data lines, arranged in one direction, for transmitting data currents;

a plurality of signal lines, crossing the data lines, for transmitting scan signals;

a pixel circuit, formed at a pixel area located where one said data line and one said signal line cross over each other, the pixel circuit including a first switch for transmitting one said data current provided from the one said data line in response to one said scan signal applied from the one said signal line, a capacitor for charging a voltage corresponding to the one said data current provided from the first switch, a light emitting element, and a first transistor for supplying a current corresponding to the voltage charged in the capacitor to the light emitting element; and a precharger comprising a second transistor for supplying a precharge current having a magnitude that varies proportionally to a magnitude of the one said data current as X times the magnitude of the one said data current to the one said data line before the one said data current is supplied to the one said data line, wherein the first transistor and the second transistor are configured as a current mirror to supply the precharge current to the data lines prior to said current being supplied to the light emitting element, and wherein the second transistor is configured to supply a majority portion of the precharge current and the first transistor is configured to supply a remaining portion of the precharge current.

14. The display panel of claim 13, wherein a current which is X−1 times the one said data current in the precharge current supplied through the one said data line is bypassed when supplying the precharge current, the first switch is turned on in response to the one said scan signal, and the voltage which corresponds to the one said data current is precharged in the capacitor.

15. The display panel of claim 13, wherein the precharger further comprises a second switch for transmitting the precharge current provided from the one said data line in response to a control signal.

16. The display panel of claim 13, wherein the one said signal line comprises a select signal line for transmitting a first said scan signal, and an emit select signal for transmitting a second said scan signal, and wherein the pixel circuit writes as a voltage the current provided from the one said data line in response to the first said scan signal, and performs a display operation according to the written voltage in response to the second said scan signal.

17. A method for driving a light emitting display device including a pixel circuit formed at a pixel area located where a data line and a signal line cross over each other, the pixel circuit including a capacitor, a first transistor for supplying a current corresponding to a voltage charged in the capacitor, and a light emitting element, the method comprising:

(a) supplying a precharge current by utilizing a current mirror formed by the first transistor and a second transistor in a precharger to generate the precharge current having a magnitude that varies proportionally to a magnitude of a data current as X times the magnitude of the data current to the data line to precharge the data line, wherein the first transistor and the second transistor are configured to supply said precharge current to the data line prior to said current being supplied to the light emitting element, wherein the second transistor is configured to supply a majority portion of the precharge current and the first transistor is configured to supply a remaining portion of the precharge current;

(b) charging a voltage which corresponds to the data current transmitted from the data line in the capacitor in response to a first level scan signal provided from the signal line; and (c) allowing the light emitting element to emit light in response to a current which corresponds to the voltage charged in the capacitor in response to a second level scan signal provided from the signal line.

18. The method of claim 17 wherein (a) comprises:

supplying the precharge current which is X times the data current, where X is a real number greater than 1;

bypassing the current which is X−1 times the data current in the precharge current; and charging the voltage which corresponds to the data current in response to the first level scan signal transmitted from the signal line.

19. The method of claim 17, wherein a time for performing the precharge of the data line is greater than 1/X times a horizontal period of the light emitting display device.

* * * * *